US006725960B1

(12) United States Patent
Schonlau

(10) Patent No.: US 6,725,960 B1
(45) Date of Patent: Apr. 27, 2004

(54) DEVICE AND METHOD FOR THE ELECTROMOTIVE REGULATION OF AN ACTUATING DEVICE

(75) Inventor: Jürgen Schonlau, Walluf (DE)

(73) Assignee: Continental Teves AG & Co. OHG, Frankfurt (DE)

( * ) Notice: Subject to any disclaimer, the term of this patent is extended or adjusted under 35 U.S.C. 154(b) by 79 days.

(21) Appl. No.: 10/089,659

(22) PCT Filed: Sep. 28, 2000

(86) PCT No.: PCT/EP00/09516

§ 371 (c)(1),
(2), (4) Date: Mar. 29, 2002

(87) PCT Pub. No.: WO01/25868

PCT Pub. Date: Apr. 12, 2001

(30) Foreign Application Priority Data

Oct. 1, 1999 (DE) ..... 199 47 500

(51) Int. Cl.[7] ..... G05G 1/14; B60K 28/10

(52) U.S. Cl. ..... 180/271; 180/279; 74/560

(58) Field of Search ..... 180/271, 277, 180/279, 315, 334; 280/775; 701/49; 74/512, 560; 318/551

(56) References Cited

U.S. PATENT DOCUMENTS 4,809,180 A * 2/1989 Saitoh ..... 701/49
5,207,451 A * 5/1993 Furuse et al. ..... 280/775
5,449,199 A * 9/1995 Heinrichs et al. ..... 280/775
5,596,840 A * 1/1997 Teich ..... 49/26
5,722,302 A * 3/1998 Rixon et al. ..... 74/512
6,151,984 A * 11/2000 Johansson et al. ..... 74/512
6,253,144 B1 * 6/2001 Yamamura et al. ..... 701/96
6,316,897 B1 * 11/2001 Ewing ..... 318/551
6,352,007 B1 * 3/2002 Zhang et al. ..... 74/512
6,516,683 B2 * 2/2003 Sundaresan et al. ..... 74/560

FOREIGN PATENT DOCUMENTS

| | | |
|---|---|---|
| DE | 41 30 370 | 3/1992 |
| DE | 41 22 629 | 1/1993 |
| DE | 41 27 047 | 2/1993 |
| DE | 42 16 963 | 11/1993 |
| DE | 195 17 958 | 11/1995 |
| DE | 195 19 309 | 11/1996 |
| DE | 196 03 648 | 8/1997 |
| DE | 196 23 420 | 12/1997 |
| EP | 0 918 273 | 5/1999 |

OTHER PUBLICATIONS

Search Report of the German Patent Office for Appln 19947500.8; dated Dec. 2001.

* cited by examiner

*Primary Examiner*—David R. Dunn
(74) *Attorney, Agent, or Firm*—Rader, Fishman & Grauer PLLC

(57) ABSTRACT

A device for the electromotive regulation of an actuating device of an automotive vehicle including an electromotive adjusting device for at least one actuating member and a control unit that is electrically connected thereto, which, in turn, is connected to electric switching device, and that at least one actuation detection means that is connected electrically to the control unit is provided to monitor an actuation of the actuating member so that in the case of a safety-critical condition an electric signal which locks the electromotive regulation can be sent from the control unit, or the energization of the electromotive adjusting device can be interrupted. The present invention prevents an electromotive regulation to take place at an inappropriate time, that means during safety-critical conditions, e.g., during a brake application or when the vehicle is moving.

5 Claims, 1 Drawing Sheet

DEVICE AND METHOD FOR THE ELECTROMOTIVE REGULATION OF AN ACTUATING DEVICE

TECHNICAL FIELD

The present invention generally relates to a device and a method for adjusting an actuating device and more particularly relates to a device and method for interrupting the movement of an actuating member in a safety-critical condition.

DESCRIPTION OF PRIOR ART

EP 918 273 A1 discloses a foot actuating device for an automotive vehicle which is adjustable in its position relative to a vehicle seat. The said device comprises a pedal assembly to be mounted on the vehicle, to which a control arm with an electromotive adjusting device is articulated for the purpose of adjustment of control arms. Pivoted to the control arm as proper actuating members 2 are several pedal levers, for example, for brake and clutch actuation, which transmit the actuating movement to associated transmission means such as hydraulic generating cylinders, Bowden cables, control arms, or similar elements. Of course, electric transmission means are also feasible, as is known in the art with respect to accelerator pedals, for example. The electromotive adjusting device comprises an electric-motor and gear assembly which is connected to the vehicle electrical system and operable by electric switching means.

It is in the nature of things that electromotive adjusting devices of this type are operable any time, that during driving. One consequence is that the actuating geometry for the vehicle operator changes in a safety-critical situation (an actuation or a potential actuation) and that the vehicle operator must get used to this new geometry. This is problematic because the 'feeling for the positioning of the pedal assembly' often times takes getting familiar with. More specifically, it cannot be excluded that, especially when a very quick (brake) reaction is needed, the brake pedal cannot be found at first because it is not at its (customary) usual place and this state of affairs has not yet been processed in the subconscious. It is also possible that the pedal is actuated only by parts of the foot, there being a greater risk of the foot slipping off the pedal and an increased risk of injury.

Especially the adjustment of steering wheels during driving involves an increased accident hazard if e.g. the adjusted position has not been locked. It is for this reason that in many operating instructions from vehicle makers there is an express warning not to adjust the steering wheel during driving.

BRIEF SUMMARY OF THE INVENTION

An object of the present invention is to provide a device and a method for the electromotive regulation of an actuating device which ensures a higher degree of reliability in connection with the electromotive adjusting function.

This object is achieved in a first solution in that according to the invention associated with the actuating device is an electromotive adjusting device for at least one actuating member and a control unit that is electrically connected thereto, the control unit, in turn, being connected to electric switching means, and in that at least one actuation detection means that is connected electrically to the control unit is provided to monitor an actuation of the actuating member so that in the case of a safety-critical condition an electric signal can be sent to the control unit which locks the electromotive regulation, or the energization of the electromotive adjusting device can be interrupted. The entirety of the features of the invention prevents an adjustment of the actuating device if this would entail additional risks.

According to second solution the object is achieved in that associated with the actuating device is an electromotive adjusting device for at least one actuating member and a control unit that is electrically connected thereto, the control unit, in turn, being connected to electric switching means, and in that there is provision of wheel speed sensors which are at least indirectly connected to the electric control unit for the adjusting device so that wheel speed signals received in the control unit produce control signals which lock the electromotive regulation or interrupt the energization of the electromotive adjusting device. Consequently, in one embodiment, the present invention utilizes the vehicle movement as a decisive criterion for an interruption or inhibition of the adjusting action.

Also, a combination of the features of the named first and second solution is possible inasfar as actuation detection means and wheel speed sensors are provided and a signal from both of them can be introduced into the control unit. For such an especially secured case it is envisaged that both described criteria for hindering/interrupting an adjustment are taken into account.

In a favorable embodiment of the present invention the electric control unit, by way of a bus system, is connected to a central controller which preferably monitors the local electric control units of the comfort zone (central locking system, mirror adjustment, seat adjustment, electric window lifter). This permits a connection to an electronic vehicle bus system or an electronic on-board diagnosis system. More specifically, it is rendered possible to monitor the functional condition of the respective vehicle assemblies any time, namely, without speed loss, without restrictions of functionalities and, also, with little effort especially in terms of wiring.

In another embodiment of the present invention each one brake pedal lever with an actuation detection means (brake light switch) and an accelerator pedal lever with actuation detection means (electric pedal positioning member, travel sensor, actuating switch) is provided, in the capacity of actuating members, and connected to the electric control unit. An actuating signal of only one of the actuation detection means causes locking of the adjusting device within the control unit. Consequently the second solution makes a vehicle movement the criterion of decision for an adjusting action.

In a favorable manner, a clutch pedal lever with an associated actuation detection means (cruise control switch) can be provided in addition and connected electrically to the control unit so that the above-described electrically operable locking of the adjusting function occurs also in the event of clutch application.

DETAILED DESCRIPTION OF THE PREFERRED EMBODIMENTS

Figure 1:
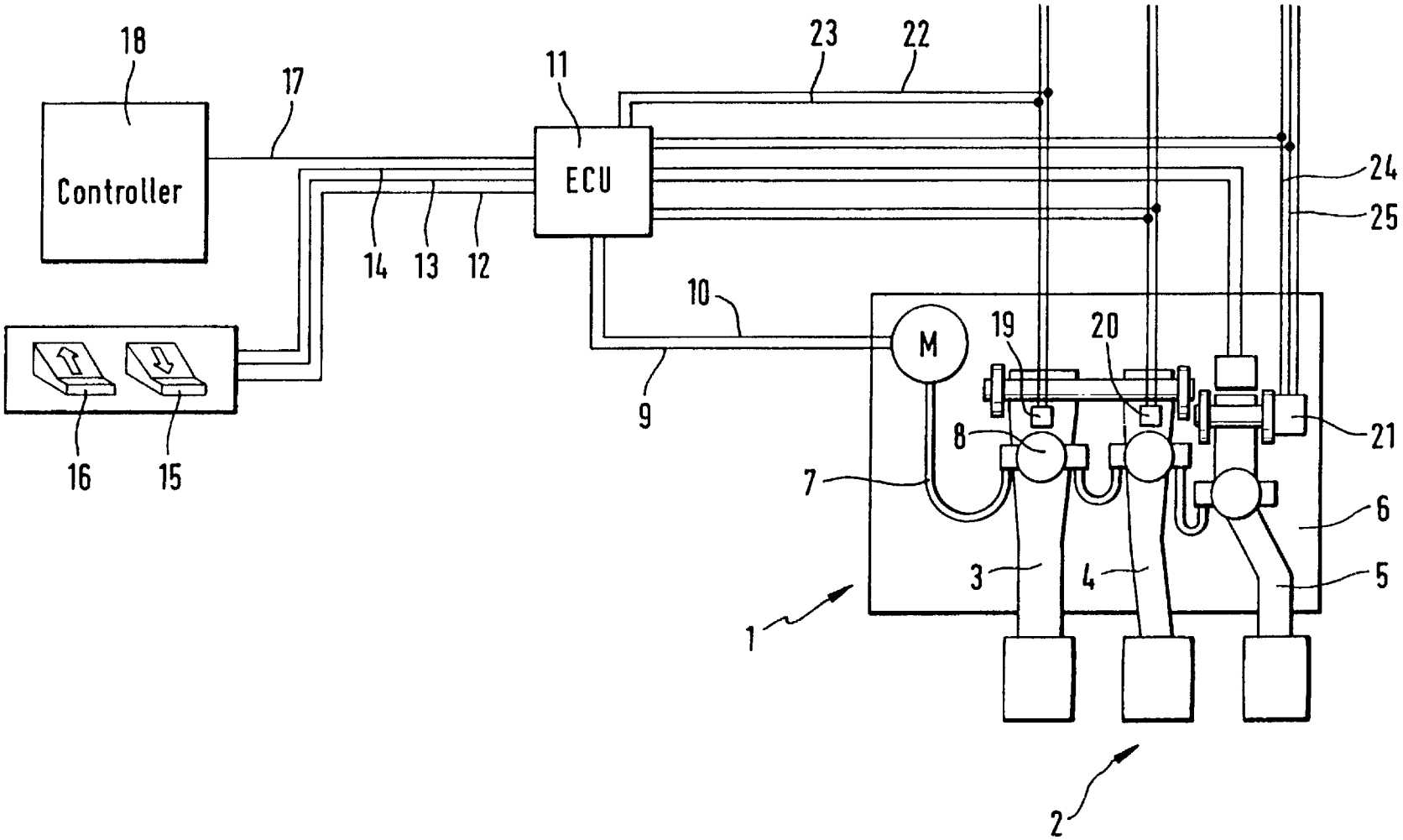
FIG. 1 is a schematic diagram showing a circuit branch of an electrical vehicle system which is responsible for the adjustment of an electromotive foot actuating device 1.

FIG. 1 discloses a foot actuating device 1 which is adjustable by means of a motor M in its position relative to a vehicle seat (not shown) and which comprises, as actuating members 2, three pedal levers 3, 4, 5 in total which are articulated in an adjustable and pivotable fashion to a control arm 6 by way of the electromotive adjusting device and a respectively pertaining drive shaft 7 and gear unit 8 in its position relative to a vehicle seat. The adjustment of all pedal levers 3, 4, 5 is carried out synchronously what is achieved, according to the embodiment, in that only the gear unit of the clutch pedal lever 3 is directly fed by the motor M, while the gear units of the other pedal levers 4, 5 tap the pedal lever with a drive shaft which is in each case closer to the motor. The control arm 6 is articulated at a pedal assembly on the vehicle (not shown) which forms a pivot for the adjustment of the foot actuating device 1. The electromotive adjusting device is connected by way of electric signal lines 9, 10 to an electric control unit 11 which, in turn, by way of signal lines 12, 13, 14, is connected to electric actuating means 15, 16 (switches) for the adjusting device and, irrespective thereof, to a controller 18 by way of a data bus 17 (preferably by using the CAN protocol). Each of the switching means 15, 16 is responsible for a defined adjusting direction. It is advisable that the controller 18 also takes care of other comfort-oriented electromotive vehicle functions, such as the seat adjustment, mirror adjustment, window lifter, central locking system, or similar units, and also monitors their function in the way of an on-board diagnosis and for the communication between the individual aggregates. Such a communication is suitable especially in the case of defects in the vehicle electrical system, for example, when the voltage supply is limited due to a system battery and a priority of functions among the aggregates must be realized. For example, it may be achieved thereby that in the event of current shortage, to the end of achieving a current-saving function, only a door-lock module (as an emergency operation) is operated, or that the electromotive adjustment is locked because it is a comfort unit which is dispensable.

As can also be seen in FIG. 1, an actuation detection means 19, 20, 21, namely an electric switching or sensor means for monitoring the pedal lever actuation, is associated with each actuating member 2 (pedal lever) and, in turn, is connected to the control unit 11 by way of electric lines 22, 23.

The basic function of the various disclosed embodiments is explained below:

When the vehicle operator wishes to adjust the foot actuating device by actuating a switching means 15, 16 whose signal is sent to the control unit 11, a polling will be performed in the control unit 11 before the control command is executed as to whether a safety-relevant condition prevails, that means, whether the vehicle is e.g. moving, or whether there is an actuation situation at present. In case no safety-relevant situation has been signalled, the control unit 11 relays corresponding adjusting signals to the electromotive adjusting device. If, however, actuating signals or wheel speed signals prevail in the control unit 11 (which characterize a safety-relevant status), the control unit 11 will emit a signal that locks the adjustment or simply interrupts the electric energization. Whether a locking signal is emitted or the energization is interrupted basically depends on the operating mode of the motor M because the latter can be fed with direct current in a conventional manner, or by means of a pulse-width modulated signal (PWM) which would necessitate a locking signal of the control unit 11.

The present invention can be realized in a particularly low-cost manner when absolutely necessary components perform the function of the actuation detection means 15, 16 so that synergy effects occur. This is possible, for example, by means of a brake light switch which sends a signal already during a brake application. Consequently, the brake light switch may additionally be used as an actuation detection means 15, 16. Principally the same applies with respect to the clutch pedal lever 3 for a cruise control switch or with respect to an electrifiable accelerator pedal lever 5 for a pedal positioning sensor (potentiometer of an electronically controlled acceleration device) which produces a signal for each case of actuation.

Because several actuating members 2, i.e., at least one accelerator pedal lever 5 and one brake pedal lever 4, are provided in each automotive vehicle, a travel sensor s is further associated with the accelerator pedal which has an electric connection 24, 25 to the control unit 11 and senses a relative adjustment between the accelerator pedal lever 5 and the brake pedal lever 4 in such a way that the adjustment action is interrupted in the event of an isolated adjustment of the brake pedal lever 4 which is caused by a defect. This prevents that e.g. if the drive shaft breaks, which connects the gear unit of the brake pedal lever adjustment with the gear unit of the accelerator pedal lever adjustment, only an adjustment of the brake pedal lever takes place, and the accelerator pedal lever 5 remains in its position. This measure is important for the synchronized distribution of all pedal levers 3, 4, 5 because it is thereby prevented that the brake pedal lever 4 (and the clutch pedal lever 3, as the case may be) will be positioned behind the accelerator pedal lever 5 from the view of the vehicle operator. More specifically, the objective is to maintain the position of the individual pedal levers 3, 4, 5 relative to each other during each adjustment action and also in the case of a defect of the mentioned shaft, and it has to be taken into consideration that the actuating element (pad) of the brake pedal lever 4 from the view of the vehicle operator is typically arranged several millimeters in front of the pad of the accelerator pedal lever 5.

According to the method for the electromotive regulation of an actuating device, a switching signal is sent to an electric control unit 11 for switching on the electromotive adjusting device. In parallel thereto, at least one signal of at least one actuation detection means 19, 20, 21 can be sent to the control unit 11. If the actuation detection means 19, 20, 21 do not send any signal at all, the adjusting device is set into operation according to its purpose. If, however, there is an actuating signal in the control unit 11, it will emit a signal that interrupts the adjustment in the direction of the adjusting device, or simply interrupts the energization of the adjusting device. Thus, the control unit 11 identifies a safety-relevant action (actuation, vehicle movement, or other conditions) and interrupts the adjusting operation or does not allow such operation in this case. The method at issue can also be performed by replacing the actuation detection means by a wheel speed sensor so that a vehicle movement is taken into account as- a criterion for the described locking arrangement. Mixed forms and especially the combination of actuation detection means 19, 20, 21 and wheel speed sensors are also possible to take into account both the vehicle movement and the actuation as criteria for discontinuing or locking an adjustment operation.

Further, it is principally feasible to find beside the vehicle movement or a current actuation still other criteria for a safety-relevant condition which sense with appropriate detection means and the signals of which would have to be sent to the control unit 11 to allow locking or termination of the energization.

Although the present invention was described hereinabove exclusively with respect to a foot actuating device 1 for an automotive vehicle, its use is not limited to this purpose. It is especially possible to furnish other adjusting devices such as hand actuating devices (steering wheel adjustments) with the present invention in order to reach a higher degree of safety. Also, it would be suitable and feasible to extend the present invention at least to other means of transportation equipped with actuating devices (for example, rail vehicles, air craft, ships).

What is claimed is:

1. Device for the electromotive actuation of a foot actuating device for operating a vehicle, comprising:

an electromotive adjusting device coupled to at least one foot actuating member for operating a vehicle, a control unit electrically connected to said electromotive adjusting device for sending an electrical activation signal to said electromotive adjusting device, electric switching means connected to said control unit, at least one actuation detection means connected electrically to the control unit for monitoring the actuation of the actuating member, wherein in the event of a safety-critical condition, said control unit does not send an electrical activation signal to said electromotive adjusting device.

2. Device of claim 1, further including wheel speed sensors which are at least indirectly connected to the electric control unit wherein the control unit does not send an electrical activation signal to said electromotive adjusting device when the vehicle is moving.

3. Device as claimed in claim 1, wherein the electric control unit is connected to a controller by way of a data bus.

4. Device as claimed in claim 1, wherein at least one actuation detection means is a brake light switch, a cruise control switch, or an accelerator pedal sensor.

5. Device as claimed in claim 1, wherein an accelerator pedal lever is provided as an actuating member, and associated with the accelerator pedal lever is a travel sensor which is electrically connected to the control unit, wherein said travel sensor senses a relative displacement between the accelerator pedal lever and a brake pedal lever in such a manner that the adjustment action is interrupted in the case of an isolated adjustment of the brake pedal lever.

* * * * *